US007386899B2

(12) United States Patent
Smith

(10) Patent No.: US 7,386,899 B2
(45) Date of Patent: Jun. 17, 2008

(54) MEDICAL EXAMINATION TABLE WITH PULLOUT STEP

(75) Inventor: Arthur D. Smith, Greenville, OH (US)

(73) Assignee: Midmark Corporation, Versailles, OH (US)

( * ) Notice: Subject to any disclaimer, the term of this patent is extended or adjusted under 35 U.S.C. 154(b) by 87 days.

(21) Appl. No.: 11/225,947

(22) Filed: Sep. 14, 2005

(65) Prior Publication Data

US 2007/0056102 A1 Mar. 15, 2007

(51) Int. Cl.
*A47B 23/02* (2006.01)

(52) U.S. Cl. ..... 5/507.1; 5/624

(58) Field of Classification Search ..... 5/507.1, 5/600, 624, 621, 658, 613; 312/235.1, 350; 297/423.21, 423.41; 108/25
See application file for complete search history.

(56) References Cited

U.S. PATENT DOCUMENTS

| | | | | |
|---|---|---|---|---|
| 217,646 | A | 7/1879 | Sherer | |
| 487,625 | A | 12/1892 | Kales | |
| 488,649 | A | 12/1892 | Daggett | |
| 542,060 | A | 7/1895 | Lentz | |
| 988,513 | A | 4/1911 | Shea et al. | |
| 996,811 | A | 7/1911 | Tarbet | |
| 1,039,708 | A | 10/1912 | Denquer | |
| 1,177,390 | A | 3/1916 | Daniel | |
| 1,216,172 | A | 2/1917 | Schulz | |
| 1,250,946 | A | 12/1917 | Belden | |
| 1,336,240 | A | 4/1920 | Knight | |
| 1,608,841 | A | 11/1926 | DeCanio | |
| 1,608,848 | A | 11/1926 | Gallowitz | |
| 1,649,053 | A | 11/1927 | Allison | |
| 1,652,065 | A | 12/1927 | Tascarella | |
| 1,684,889 | A | 9/1928 | Russ | |
| 1,817,878 | A | 8/1931 | Clements, Jr. | |
| 1,891,629 | A | 12/1932 | Van Wagner | |
| 1,930,882 | A | 10/1933 | McRae | 45/82 |
| 1,967,422 | A | 7/1934 | Nadelson | 45/68.3 |
| 2,242,357 | A | 5/1941 | Kroll et al. | 5/100 |
| RE21,972 | E | 12/1941 | Demcak | 311/7 |

(Continued)

FOREIGN PATENT DOCUMENTS

| | | |
|---|---|---|
| DE | 131602 | 6/1902 |

(Continued)

OTHER PUBLICATIONS www.midmark.com as archived by archive.org on Dec. 29, 2003. Direct Link: http://web.archive.org/web/20031228234158/www.midmark.com/defaultproducts.asp?hierarchyID=11.*

*Primary Examiner*—Patricia Engle
*Assistant Examiner*—William Kelleher
(74) *Attorney, Agent, or Firm*—Wood, Herron & Evans, LLP

(57) ABSTRACT

A medical examination table has a step that is movable between a stowed position within the base of the table, to an extending position for use by persons mounting or dismounting the table. Slide members are coupled to the step inboard from the lateral sides of the step, so that the slide members are hidden from view even when the step is placed in the extended position. The step is suspended above a floor surface by the slide members and lower support members provided on a bottom side of the step, to facilitate movement of the step between the stowed and extended positions.

11 Claims, 6 Drawing Sheets

U.S. PATENT DOCUMENTS

| | | | | |
|---|---|---|---|---|
| 2,267,973 | A | 12/1941 | Demcak | 311/10 |
| 2,272,819 | A | 2/1942 | Poetsch et al. | 312/162 |
| D132,293 | S | 5/1942 | Fay | |
| D132,294 | S | 5/1942 | Fay | |
| 2,495,374 | A | 1/1950 | Horn | 4/135 |
| 2,532,705 | A | 12/1950 | Freund | 5/80 |
| 2,563,436 | A | 8/1951 | Toth | 228/30 |
| 2,565,784 | A | 8/1951 | Sheean | 312/286 |
| 2,606,801 | A | 8/1952 | Shampaine | 311/10 |
| 2,628,145 | A | 2/1953 | Slattery | 312/205 |
| D170,305 | S | 9/1953 | Claus | D33/14 |
| 2,652,887 | A | 9/1953 | Fitzgerald | 155/188 |
| 2,659,902 | A | 11/1953 | Fitzgerald et al. | 5/92 |
| 2,679,445 | A | 5/1954 | Roehm | 312/209 |
| 2,682,671 | A | 7/1954 | Faure | 5/92 |
| 2,788,529 | A | 4/1957 | Moritzacky et al. | 5/72 |
| D180,542 | S | 7/1957 | Barrow | D15/1 |
| 2,801,894 | A | 8/1957 | MacInnes | 312/235 |
| 2,904,798 | A | 9/1959 | Heflin | 5/317 |
| 2,941,215 | A | 6/1960 | Johnson | 5/92 |
| 2,975,436 | A | 3/1961 | Ries | 5/317 |
| 3,016,275 | A | 1/1962 | Grant | 312/209 |
| 3,083,053 | A | 3/1963 | Dorsey | 297/153 |
| 3,101,940 | A | 8/1963 | Anderson | 269/322 |
| 3,143,803 | A | 8/1964 | Lunn | 32/22 |
| 3,178,169 | A | 4/1965 | Kanzelberger | 269/324 |
| D204,222 | S | 3/1966 | Dailey | D83/1 |
| 3,281,141 | A | 10/1966 | Smiley et al. | 269/325 |
| D207,081 | S | 2/1967 | Katzfey et al. | D83/1 |
| 3,306,692 | A | 2/1967 | Timmerman | 312/231 |
| D207,483 | S | 4/1967 | Dottinger | D10/8 |
| 3,334,951 | A | 8/1967 | Douglass, Jr. et al. | 312/209 |
| 3,348,893 | A | 10/1967 | Katzfey et al. | 312/209 |
| 3,409,287 | A | 11/1968 | Chervenka | 269/328 |
| 3,413,663 | A | 12/1968 | Swann | 5/81 |
| 3,499,529 | A | 3/1970 | Katzfey et al. | 269/325 |
| 3,612,509 | A | 10/1971 | Boston et al. | 269/328 |
| 3,638,935 | A | 2/1972 | Lelugas et al. | 269/324 |
| 3,655,179 | A | 4/1972 | Lelugas | 269/324 |
| 3,658,317 | A | 4/1972 | Bartlett et al. | 269/325 |
| 3,814,414 | A | 6/1974 | Chapa | 269/323 |
| 3,944,205 | A | 3/1976 | Mueller | 269/328 |
| 4,003,704 | A | 1/1977 | Zurolo et al. | 21/91 |
| 4,034,972 | A | 7/1977 | Peterson | 269/324 |
| D245,287 | S | 8/1977 | Damico et al. | D24/3 |
| 4,045,078 | A | 8/1977 | Shine | 269/324 |
| 4,057,240 | A | 11/1977 | Damico et al. | 269/325 |
| 4,076,230 | A | 2/1978 | Pike | 269/328 |
| D250,043 | S | 10/1978 | Shine | D24/3 |
| 4,168,099 | A | 9/1979 | Jacobs et al. | 297/325 |
| 4,180,002 | A | 12/1979 | Huempfner | 108/6 |
| 4,183,596 | A | 1/1980 | Greene et al. | 312/333 |
| 4,221,371 | A | 9/1980 | Kuphal | 269/327 |
| 4,284,268 | A | 8/1981 | Gauthier | 269/328 |
| 4,287,422 | A | 9/1981 | Kuphal et al. | 250/439 |
| 4,291,929 | A * | 9/1981 | Faust | 312/334.4 |
| D263,777 | S | 4/1982 | Thompson | D6/129 |
| 4,322,899 | A | 4/1982 | Clune | 37/86 |
| D265,241 | S | 6/1982 | Patterson | D24/3 |
| D265,242 | S | 6/1982 | Patterson | D24/3 |
| D266,023 | S | 8/1982 | McLachlan | D24/3 |
| D266,765 | S | 11/1982 | Clune | D15/21 |
| 4,383,351 | A | 5/1983 | Fenwick | 24/263 |
| 4,407,687 | A | 10/1983 | Mitchell | 156/227 |
| 4,501,414 | A | 2/1985 | Mason et al. | 269/325 |
| 4,506,872 | A | 3/1985 | Westerberg et al. | 269/322 |
| 4,508,387 | A | 4/1985 | Gilbert et al. | 297/429 |
| D278,668 | S | 5/1985 | Simpkins | D6/335 |
| 4,516,805 | A | 5/1985 | Leeper et al. | 297/330 |
| 4,529,185 | A | 7/1985 | Gutierres | 269/326 |
| 4,540,165 | A | 9/1985 | Green et al. | 269/325 |
| 4,545,628 | A | 10/1985 | Richey | 312/235 |
| 4,547,092 | A | 10/1985 | Vetter et al. | 403/59 |
| 4,552,403 | A | 11/1985 | Yindra | 297/330 |
| 4,557,471 | A | 12/1985 | Pazzini | 269/325 |
| 4,558,857 | A | 12/1985 | Heller | 269/325 |
| D282,398 | S | 1/1986 | Yindra | D24/7 |
| 4,586,398 | A | 5/1986 | Yindra | 74/512 |
| 4,586,762 | A | 5/1986 | Kennedy et al. | 312/330 |
| 4,589,642 | A | 5/1986 | Schnelle et al. | 269/325 |
| 4,600,248 | A | 7/1986 | Pflieger | 312/195 |
| 4,602,756 | A | 7/1986 | Chatfield | 248/225.1 |
| 4,606,575 | A | 8/1986 | Kodet | 297/124 |
| D286,481 | S | 11/1986 | Case et al. | D6/510 |
| 4,648,389 | A | 3/1987 | Kowalski et al. | 128/70 |
| 4,653,129 | A | 3/1987 | Kuck et al. | 5/430 |
| 4,667,354 | A | 5/1987 | Carey, Jr. et al. | 5/72 |
| 4,667,605 | A | 5/1987 | Bastian | 108/144 |
| 4,691,393 | A | 9/1987 | Kuck | 5/62 |
| 4,700,916 | A | 10/1987 | Bastian et al. | 248/225.2 |
| 4,716,840 | A | 1/1988 | Tringali et al. | 108/27 |
| 4,717,102 | A | 1/1988 | Pflieger | 248/228 |
| 4,732,089 | A | 3/1988 | Mueller | 108/102 |
| 4,732,430 | A | 3/1988 | Byrns | 312/330 |
| 4,736,689 | A * | 4/1988 | Stanko | 108/5 |
| 4,750,305 | A | 6/1988 | Bastian | 52/127.11 |
| 4,752,977 | A | 6/1988 | Smith et al. | 5/93 |
| D297,597 | S | 9/1988 | Simpkins et al. | D6/391 |
| 4,796,846 | A | 1/1989 | Meier et al. | 248/286 |
| 4,805,365 | A | 2/1989 | Bastian | 52/282 |
| D300,657 | S | 4/1989 | Simpkins et al. | D24/3 |
| 4,819,569 | A | 4/1989 | Bastian et al. | 108/113 |
| 4,821,350 | A | 4/1989 | Feldt | 5/60 |
| D300,997 | S | 5/1989 | Simpkins et al. | D6/503 |
| 4,826,117 | A | 5/1989 | Bastian et al. | 248/188.2 |
| D301,925 | S | 6/1989 | Simpkins et al. | D24/3 |
| 4,846,431 | A | 7/1989 | Pflieger | 248/188.2 |
| 4,852,941 | A | 8/1989 | Jones | 297/188 |
| 4,858,260 | A | 8/1989 | Failor et al. | 5/67 |
| 4,865,303 | A | 9/1989 | Hall | 269/325 |
| 4,869,030 | A | 9/1989 | Clark | 52/79.6 |
| 4,872,657 | A | 10/1989 | Lussi | 269/325 |
| 4,905,266 | A | 2/1990 | Kuck et al. | 378/177 |
| 4,916,725 | A | 4/1990 | Quinter et al. | 378/177 |
| 4,925,245 | A | 5/1990 | Pendleton et al. | 297/440 |
| 4,937,902 | A | 7/1990 | Ceike Shapiro | 5/93 |
| 4,956,592 | A | 9/1990 | Schulte et al. | 318/560 |
| 4,958,816 | A | 9/1990 | Chaney et al. | 269/328 |
| 4,961,610 | A | 10/1990 | Reeder et al. | 297/412 |
| 4,966,351 | A | 10/1990 | Klepacki | 269/328 |
| 4,968,013 | A | 11/1990 | Kuck | 269/328 |
| 4,973,034 | A | 11/1990 | Michele | 269/324 |
| 4,996,731 | A | 3/1991 | Kruyt | 5/67 |
| 5,005,667 | A * | 4/1991 | Anderson | 182/15 |
| 5,009,282 | A | 4/1991 | Willsher | 182/88 |
| D319,158 | S | 8/1991 | Jones et al. | D6/491 |
| 5,037,053 | A | 8/1991 | Fox et al. | 248/278 |
| D321,097 | S | 10/1991 | Jones et al. | D6/367 |
| 5,078,349 | A | 1/1992 | Smith | 248/125 |
| 5,081,808 | A | 1/1992 | Bastian et al. | 52/220 |
| 5,084,927 | A | 2/1992 | Parkevich | 5/484 |
| D326,381 | S | 5/1992 | Heiligenthal et al. | D6/510 |
| D330,771 | S | 11/1992 | Chaney et al. | D24/217 |
| D330,813 | S | 11/1992 | Spitzer et al. | D6/432 |
| 5,203,135 | A | 4/1993 | Bastian | 52/726.1 |
| D335,409 | S | 5/1993 | Kellems | D6/510 |
| 5,208,928 | A | 5/1993 | Kuck et al. | 5/608 |
| 5,223,229 | A | 6/1993 | Brucker | 422/116 |
| 5,228,761 | A | 7/1993 | Huebschen et al. | 312/235.1 |
| D341,737 | S | 11/1993 | Shephard | D6/509 |
| 5,269,326 | A | 12/1993 | Verrier | 128/642 |
| D344,802 | S | 3/1994 | Kuck et al. | D24/183 |
| D345,266 | S | 3/1994 | Koguma | D6/422 |
| 5,329,657 | A | 7/1994 | Bartley et al. | 5/617 |

| | | | | |
|---|---|---|---|---|
| 5,339,750 | A | 8/1994 | Smies | 108/147 |
| 5,345,632 | A | 9/1994 | Langenaeken et al. | 5/601 |
| 5,369,825 | A | 12/1994 | Reesby | 5/613 |
| 5,369,827 | A | 12/1994 | Parke et al. | 5/649 |
| 5,403,549 | A | 4/1995 | McNeil et al. | 422/29 |
| 5,426,795 | A | 6/1995 | Harty | 4/584 |
| D365,224 | S | 12/1995 | Pohlman | D6/445 |
| 5,472,270 | A | 12/1995 | Czarnecky et al. | 312/265.6 |
| 5,496,105 | A | 3/1996 | Czarnecky et al. | 312/334.4 |
| 5,507,050 | A | 4/1996 | Welner | 5/600 |
| D370,572 | S | 6/1996 | Lin | D6/446 |
| 5,522,098 | A * | 6/1996 | Podgorschek | 5/602 |
| 5,528,782 | A | 6/1996 | Pfeuffer et al. | 5/611 |
| 5,538,215 | A | 7/1996 | Hosey | 248/286.1 |
| 5,564,662 | A | 10/1996 | Lussi et al. | 248/188.2 |
| 5,565,834 | A | 10/1996 | Hanley et al. | 335/296 |
| 5,568,209 | A | 10/1996 | Priester et al. | 351/243 |
| 5,568,817 | A | 10/1996 | Harty | 128/849 |
| 5,628,078 | A | 5/1997 | Pennington et al. | 5/618 |
| 5,638,644 | A | 6/1997 | Bastian | 52/36.6 |
| 5,645,313 | A | 7/1997 | Best et al. | 297/68 |
| 5,655,238 | A | 8/1997 | Stickley et al. | 5/621 |
| 5,660,405 | A | 8/1997 | Campbell | 280/166 |
| 5,661,859 | A | 9/1997 | Schaefer | 5/621 |
| 5,678,267 | A | 10/1997 | Kinder | 5/662 |
| 5,680,957 | A | 10/1997 | Liu | 220/663 |
| D386,634 | S | 11/1997 | Daugs | D6/509 |
| 5,706,678 | A | 1/1998 | Sasaki | 68/13 |
| 5,735,586 | A | 4/1998 | Cheng | 312/235.1 |
| 5,754,997 | A | 5/1998 | Lussi et al. | 5/618 |
| 5,755,498 | A | 5/1998 | Cutler | 312/235.1 |
| 5,758,933 | A | 6/1998 | Clendening | 312/205 |
| 5,771,513 | A | 6/1998 | Kirchgeorg et al. | 5/625 |
| 5,781,943 | A | 7/1998 | Moenning et al. | 5/81.1 |
| 5,855,207 | A | 1/1999 | Moenning et al. | 128/845 |
| 5,860,899 | A | 1/1999 | Rassman | 482/142 |
| D404,945 | S | 2/1999 | Simpkins et al. | D6/510 |
| D408,537 | S | 4/1999 | Stickley et al. | D24/184 |
| D408,538 | S | 4/1999 | Simpkins et al. | D24/184 |
| D408,539 | S | 4/1999 | Simpkins | D24/184 |
| 5,913,773 | A | 6/1999 | Cox | 5/600 |
| 5,919,131 | A | 7/1999 | Smoler et al. | 600/300 |
| 5,924,960 | A | 7/1999 | Cohen | 482/51 |
| 5,926,876 | A | 7/1999 | Haigh et al. | 5/617 |
| 5,953,773 | A | 9/1999 | Asada et al. | 5/81.1 |
| D417,098 | S | 11/1999 | Teufel et al. | D6/492 |
| D417,571 | S | 12/1999 | Teufel et al. | D6/510 |
| D418,225 | S | 12/1999 | Simpkins et al. | D24/183 |
| 6,023,800 | A | 2/2000 | Stickley | 5/621 |
| 6,038,718 | A | 3/2000 | Pennington et al. | 5/618 |
| 6,073,284 | A | 6/2000 | Borders | 5/600 |
| D428,629 | S | 7/2000 | Cohen | D21/671 |
| 6,086,176 | A | 7/2000 | Aoyama | 312/286 |
| 6,101,652 | A | 8/2000 | Matern, Jr. | 5/648 |
| 6,106,065 | A | 8/2000 | Carroll | 297/330 |
| 6,115,978 | A | 9/2000 | Bastian et al. | 52/243.1 |
| 6,131,214 | A | 10/2000 | Moenning et al. | 5/81.1 |
| 6,173,461 | B1 | 1/2001 | Alexander | 5/618 |
| 6,202,230 | B1 | 3/2001 | Borders | 5/618 |
| 6,209,463 | B1 | 4/2001 | Koharchik et al. | 108/7 |
| 6,212,713 | B1 | 4/2001 | Kuck et al. | 5/617 |
| 6,276,012 | B2 | 8/2001 | Borders | 5/622 |
| 6,295,671 | B1 | 10/2001 | Reesby et al. | 5/600 |
| 6,351,678 | B1 | 2/2002 | Borders | 700/83 |
| 6,371,584 | B1 | 4/2002 | Alreck | 312/235.1 |
| D458,780 | S | 6/2002 | Siepmann et al. | D6/510 |
| D461,899 | S | 8/2002 | Siepmann et al. | D24/183 |
| D461,900 | S | 8/2002 | Siepmann et al. | D24/184 |
| D462,674 | S | 9/2002 | Siepmann et al. | D14/183 |
| 6,550,084 | B2 * | 4/2003 | Siepmann et al. | 5/507.1 |
| 6,802,578 | B1 | 10/2004 | Lang et al. | 312/235.1 |

FOREIGN PATENT DOCUMENTS

| | | |
|---|---|---|
| DE | 489593 | 1/1930 |

* cited by examiner

MEDICAL EXAMINATION TABLE WITH PULLOUT STEP

FIELD OF THE INVENTION

The present invention relates generally to medical examination tables, and more particularly to a medical examination table having a step slidably stowed within the table.

BACKGROUND OF THE INVENTION

Medical examination tables and chairs are known in the art for supporting a patient thereon while a medical professional examines the patient or performs a medical procedure. For convenience, reference is made herein to an examination table, but it will be understood that the features and advantages of the invention are applicable to both medical examination tables and medical examination chairs.

Conventional medical examination tables may comprise a generally flat patient support surface, or may comprise a seat section and a back section supported on a base unit, wherein the seat and back sections are moveable relative to one another and the base to place the patient in a desired position. For example, the seat section or back section may be articulated by actuating mechanisms such a motors, pneumatic or hydraulic cylinders, or other devices to move the seat and back sections between the various positions and to adjust the height of the seat and back sections relative to the base. Medical examination tables also frequently include a step to assist a patient to get onto and off of the examination table. The step may be separate from the examination table, or it may be built into the table. When the steps are provided as a separate component, they take up extra space and become undesirable obstructions around the table, or within the medical practitioner's office, when not being used to mount or dismount the table. Conventional steps which are built into medical examination tables, however, are generally not easily moved between stowed and extended positions. In particular, if a step has no rolling elements to facilitate movement from the stowed to the extended position, the step is likely to snag on carpeted surfaces, or otherwise be difficult to maneuver. On the other hand, stowable steps having rollers generally do not provide a stable feel for persons using the step to mount or dismount the table.

A need therefore exists for an examination table having a stowable step which overcomes these and other drawbacks of the prior art.

SUMMARY OF THE INVENTION

The present invention provides a medical examination table having a step that is easily movable between a stowed position within a bay provided in the base of the table, and an extended position outward from the base for use by persons mounting or dismounting the table. Sliding movement of the unloaded step between the stowed and extended positions is facilitated by slide members and lower support members that support the step above the floor surface. The slide members are coupled between the step and the table base and guide the motion of the step between the stowed and extended positions. At least portions of the slide members extend interiorly of the step through apertures located inboard from the lateral sides of the step. This configuration ensures that the slide members are hidden from view, even when the step is placed in the extended position.

In another aspect of the invention, lower support members provided on the bottom side of the step cooperate with the slide members to support the unloaded step above the floor surface. The lower support members may be biased in directions outwardly from the bottom side of the housing to maintain the bottom side of the step above the floor surface until the step is loaded, such as when a person stands on the step. As the step is loaded, the lower support members are displaced to permit at least a portion of the bottom side of the step to contact the floor surface, thereby providing a stable support for persons mounting or dismounting the table.

In another aspect of the invention, the lower support members include wheels or rollers to reduce the sliding friction between the step and the floor surface as the step is maneuvered between the stowed and extended positions. The step may further include gripping elements disposed on the bottom side of the step and suspended above the floor surface in the unloaded condition. When the lower support members are displaced under load, the gripping elements contact the floor surface to provided resistance to movement while a person is standing on the step.

In yet another aspect of the invention, the step comprises a step housing and a separate cover that is placed over the step housing to define the top side of the step. The step may further include a support place disposed between the step housing and the cover, to provide additional reinforcement to the cover. The slide members may be attached to the support plate, within the interior of the step housing.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
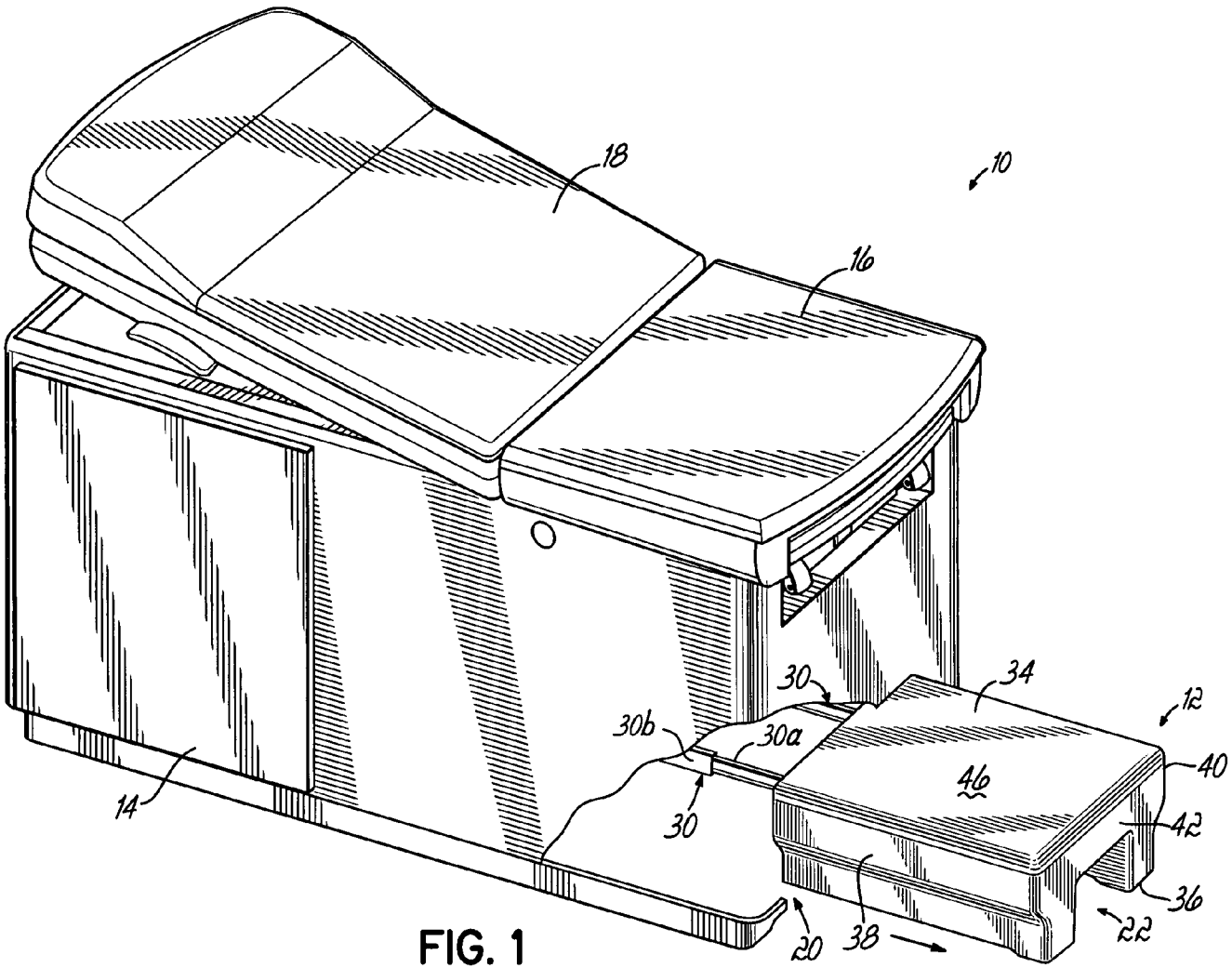
FIG. 1 is a perspective view of an exemplary medical examination table including an exemplary stowable step in accordance with the principles of the present invention and depicted in an extended position.

FIG. 1 depicts an exemplary medical examination table 10, including an exemplary stowable step 12 in accordance with the present invention and depicted in an extended position. The table 10 includes a stationary base 14 and a patient support, which may include a seat section 16 and a back section 18 mounted atop the base 14 for supporting a patient thereon. In the embodiment shown, the back section 18 is moveable relative to the seat section 16 and the base 14, between an inclined orientation for supporting a patient in a seated position, and a reclined orientation wherein the back section 18 is substantially parallel to the seat section 16 for supporting a patient in a generally supine position. It will be recognized, however, that the medical examination table 10 may alternatively comprise only a substantially flat surface for supporting a patient thereon. Generally, patients may position themselves on the examination table 10 while the back section 18 is in the inclined position, whereafter the back section 18 and/or seat section 16 may be articulated to various other orientations to facilitate examination and/or performance of a medical procedure.

An opening or bay 20 is provided in the base 14 for slidably receiving the step 12 so that it can be stowed within the base 14. The step 12 is moveable between a stowed position within the bay 20 (depicted in FIG. 3A), to an extended position (depicted in FIG. 3B) wherein the step 12 extends outwardly from the base 14 to provide a stable surface upon which patients may traverse to mount and/or dismount the table 10. With the step 12 in the stowed position, unobstructed access to the table 10 is ensured, while the step 12 may be readily extended as needed. A recess, or pocket 22, is formed in a forward facing end of the step 12 and defines convenient ledge that facilitates grasping the step 12 to move it between the stowed and extended positions. Alternatively, the recess 20 provides a convenient location whereby users may engage the step 12 with their foot to move the step 12 between the stowed and extended positions. Movement of the step 12 between the stowed and extended positions is guided by a pair of slide members 30 that couple the step 12 to the base 14 and support at least a part of the step 12 above a floor surface 32, as will be described in more detail below.

Figure 2:
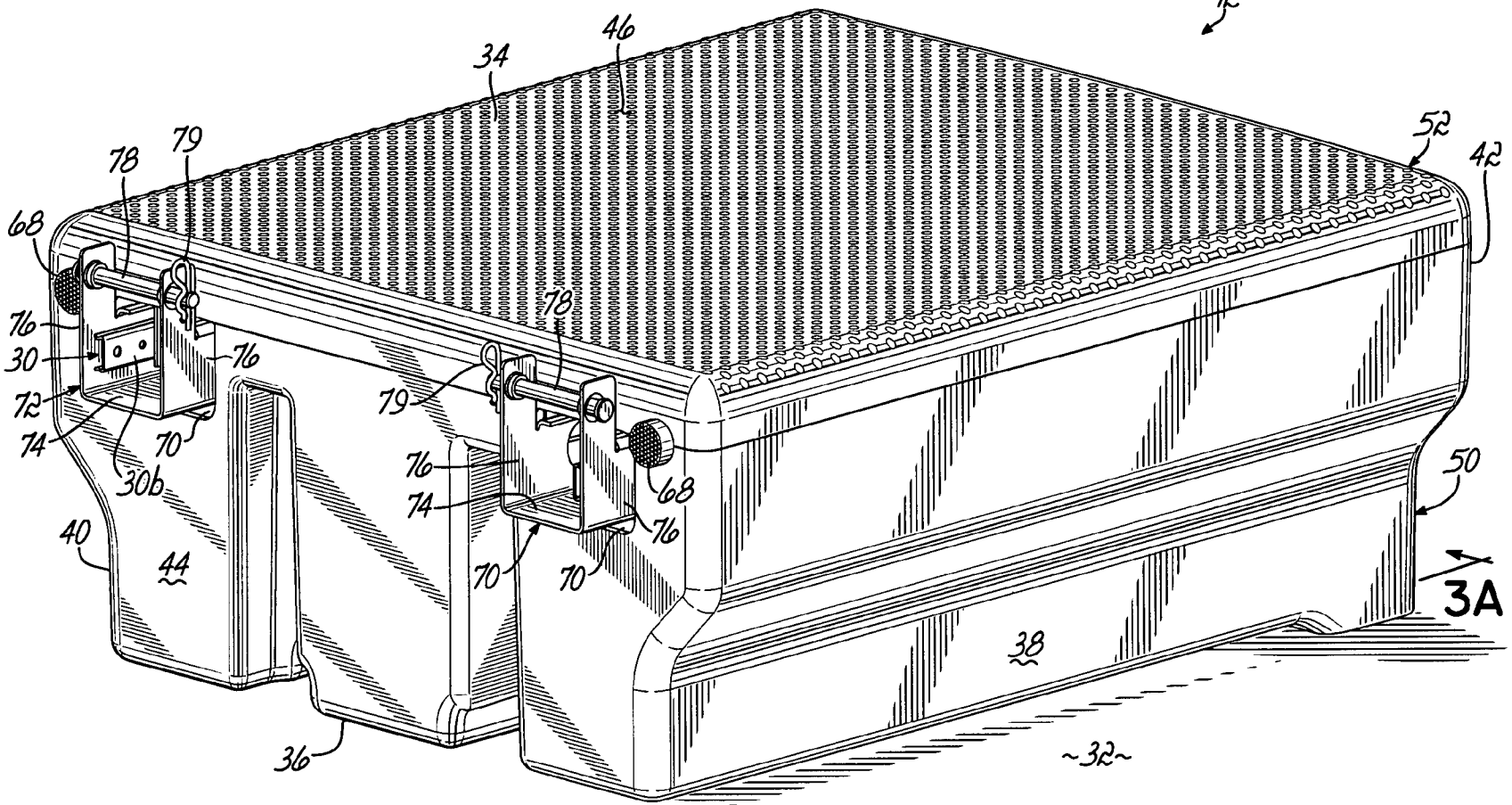
FIG. 2 is a perspective view of the stowable step of FIG. 1.
Figure 3A:
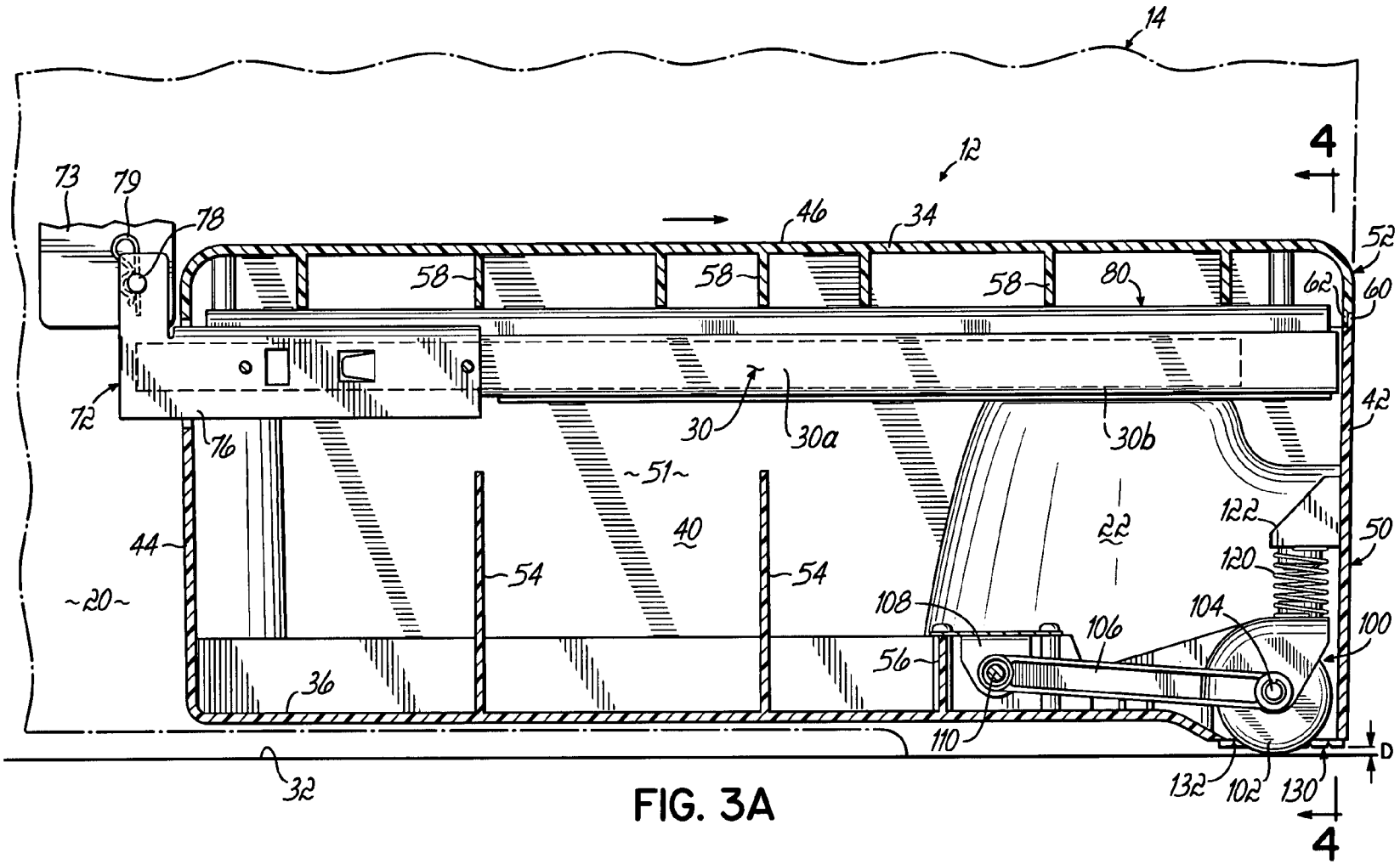
FIG. 3A is a cross-sectional view of the step of FIG. 2 taken along line 3A-3A, depicting the step in a stowed position.
Figure 3B:
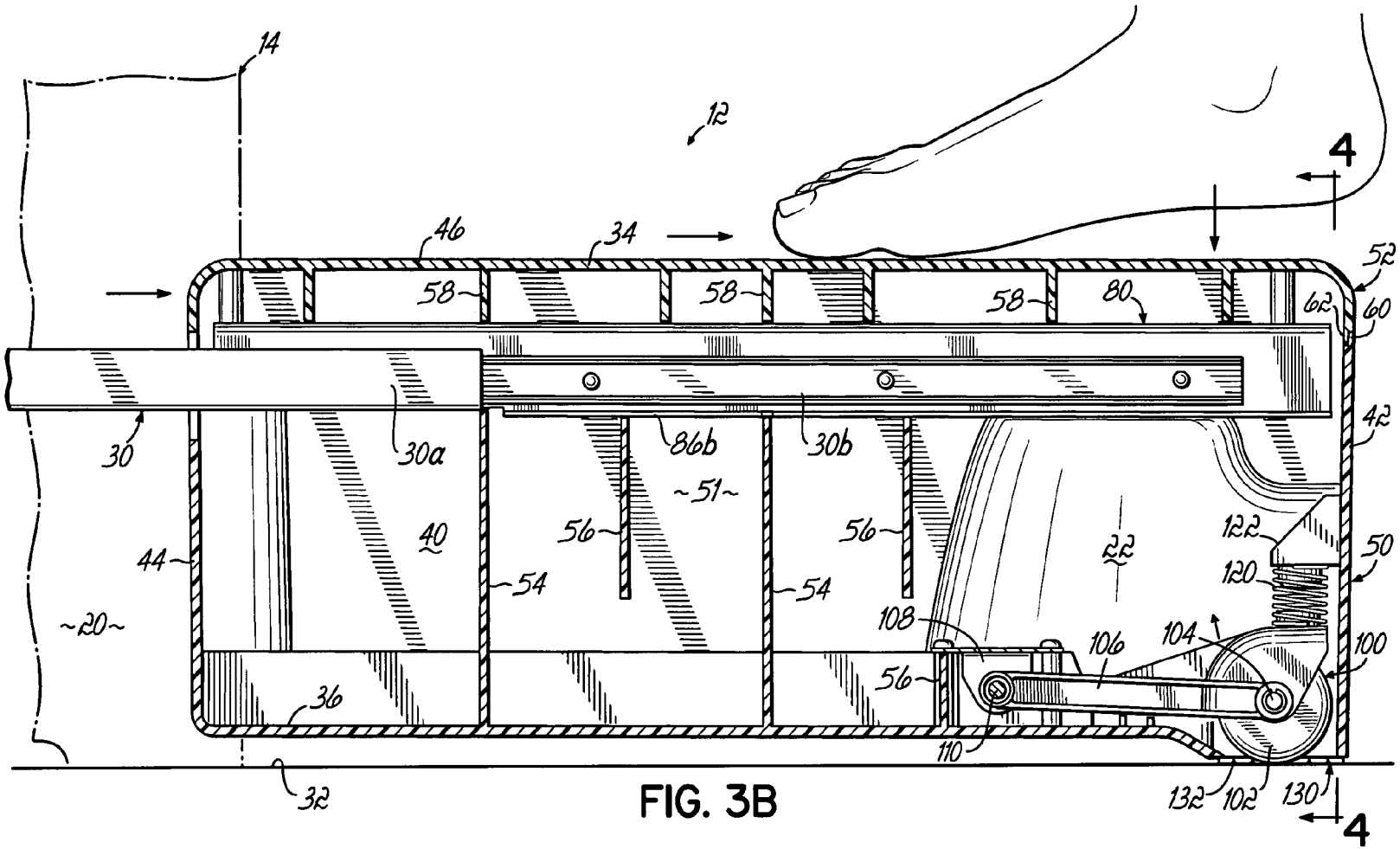
FIG. 3B is a cross-sectional view, similar to FIG. 3A, depicting the step of FIG. 2 in an extending position while under load.
Figure 4:
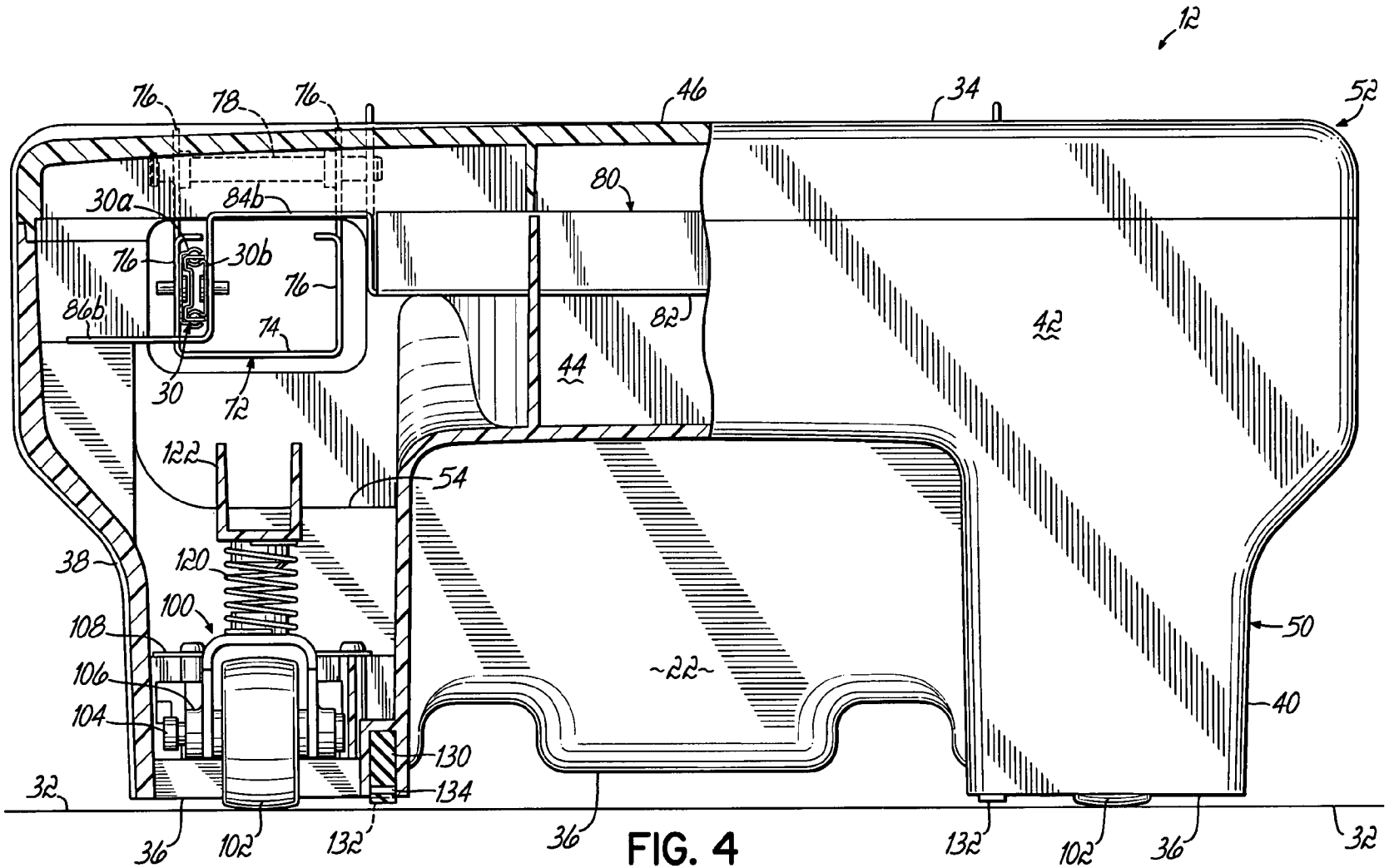
FIG. 4 is a partial cross-section view of the step of FIG. 3 taken along line 4-4.

With continued reference to FIG. 1, and referring further to FIGS. 2, 3A and 3B, the exemplary step 12 has a top side 34, a bottom side 36 opposite the top side 34, first and second oppositely disposed lateral sides 38, 40 extending between the top side 34 and the bottom side 36, and oppositely disposed front and rear sides 42, 44. The top side 34 of the step 12 includes a generally flat top surface 46 upon which persons may step to mount and dismount the table 10. The top surface 46 may be provided with a tread defined by, for example, protrusions, grooves, or various other formations thereon, as best depicted in FIG. 2, to provide traction for persons supported on the step 12.

In the embodiment shown, the step 12 includes a step housing 50, to which the various components of the step 12 are attached, and a separate cover 52 received over the step housing 50, to define the top surface 46. The step housing 50 and cover 52 may be formed from polymeric materials, such as acrylonitrile butadiene styrene (ABS), or it may be fabricated from any other material suitable for supporting the weight of a person mounting or dismounting the table 10. The tread of the top surface 46 may be formed directly into the top cover 52, or it may be provided as a separate component applied over the cover 52.

Figure 5:
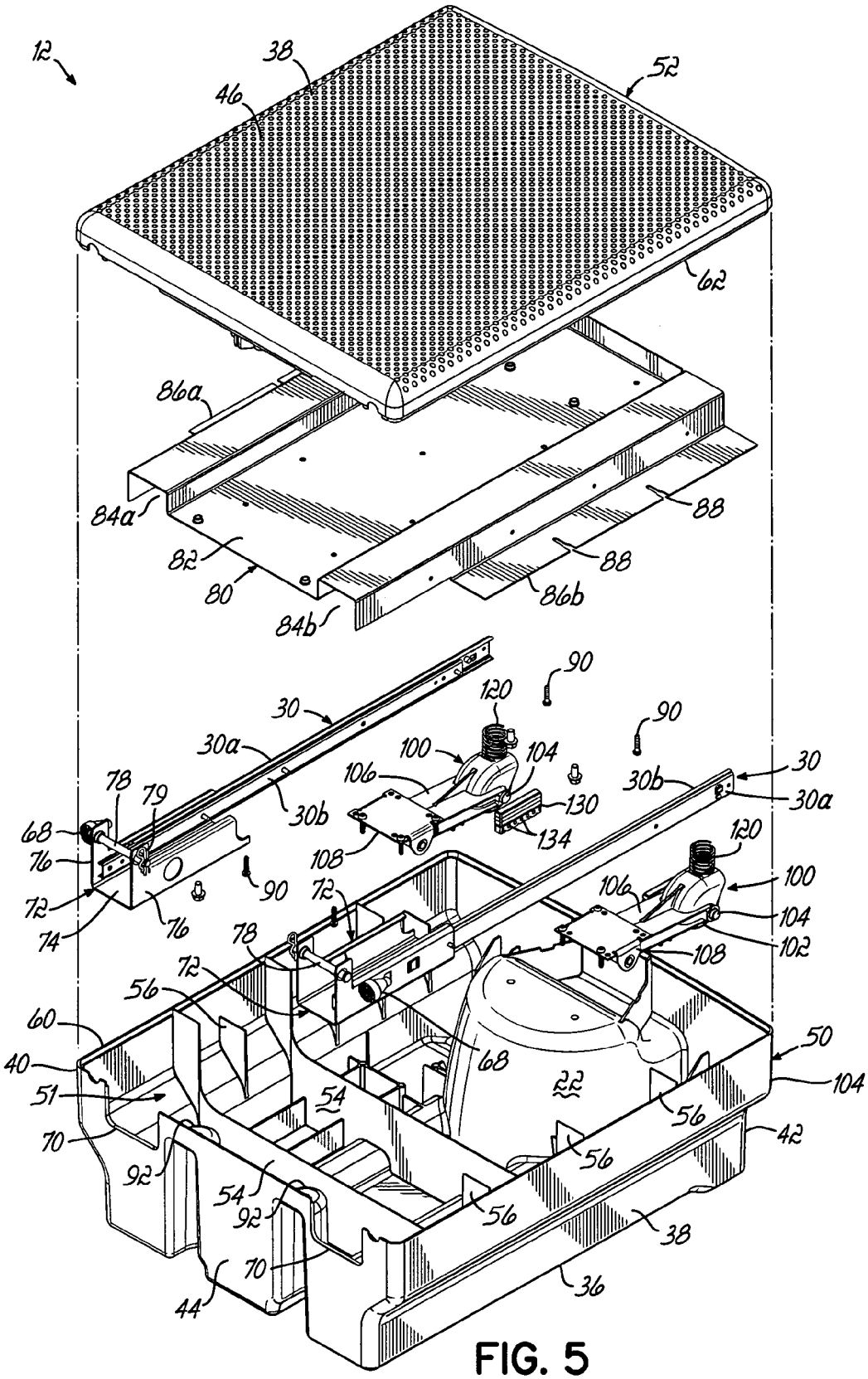
FIG. 5 is an exploded perspective view of the step of FIG. 2.

In one embodiment, the housing 50 and cover 52 are molded from polymeric material, such as ABS, and the tread of the top surface 46 is formed by overmolding a softer durometer polymeric material, such as santoprene, directly thereon to enhance the gripping ability of the tread. The molded polymeric step housing 50 has a generally hollow interior 51 (best depicted in FIG. 5), and is formed with interior walls 54 and interior ribs 56 to provide strength and rigidity to the step housing structure. The cover 52 also includes strenghthening ribs 58 to provide rigidity to the cover 52. The confronting peripheral edges of the step housing 50 and cover 52 have corresponding ledges 60, 62 configured to interlock and thereby inhibit deformation of the sides of the step housing 50 when the step 12 is loaded.

While the step housing 50, cover 52, and top surface 46 have been shown and described herein as separate components formed from polymeric materials, it will be recognized, that the step housing 50, cover 52, and top surface 46 may alternatively be formed as a single, molded unit, or that they may be fabricated from various other materials suitable for supporting the weight of a person traversing the step 12 to mount or dismount an examination table 10, and to provide traction to persons supported thereon.

The step 12 includes first and second apertures 70 on the rear side 44 of the step housing 50, providing access to the step housing interior 51. The apertures 70 are spaced inboard from the first and second lateral sides 38, 40 of the step housing 50 so that the first and second slide members 30 may be coupled to the step housing at positions inwardly of the first and second lateral sides 38, 40. In the embodiment shown, the slide members 30 are conventional roller bearings drawer slides having one or more telescoping sections 30*a*, 30*b*, as known in the art. It will be recognized, however, that the slide members 30 may comprise various other mechanisms, such as tracks and rollers, simple sliding mechanical joints, or any other mechanism suitable for guiding the step between the stowed and extended positions, while supporting at least part of the step above the floor surface.

Connecting members 72, in the form of channel-shaped brackets, are fixed to one end of the slide members 30. The brackets 72 have a bottom wall 74 and opposed sidewalls 76 extending upwardly therefrom, and are pivotally coupled to supports 73 provided on the table base 14 by pins 78 extending between the sidewalls 76 and secured thereto with spring clips 79. The slide members 30 are contained substantially within step housing interior 51 when the step 12 is in the stowed position (FIG. 3A), and extend outwardly through the apertures 70 when the step 12 is moved to the extended position (FIG. 3B). Because the slides members 30 are mounted inwardly of the first and second lateral sides 38, 40 of the step housing 50, the slides members 30 are hidden from view when the step 12 is in the extended position. This not only provides an aesthetically pleasing appearance to the step 12, but also ensures that the slide members 30 are not exposed when the step 12 is in the extended position, where they might otherwise present snag points or pinching hazards for persons near the extended step 12. The hidden configuration of the slides members 30 also provides relatively smooth surfaces on the first and second lateral sides 38, 40 of the step 12, making it easier to maintain the step 12 in a clean condition. Moreover, close dimensional tolerancing between the sides of bay 20 and the lateral sides 38, 40 of the step is not required to ensure proper operation of the slide members 30.

In the exemplary embodiment shown, the first and second slide members 30 are operatively connected to a support plate 80 which is received over the step housing 50 and beneath the top cover 52. The support plate 80 is formed from a stamped metal sheet and provides additional reinforcement to the top cover 52 for supporting a person standing on the step 12. The support plate 80 has a generally flat central portion 82 and lateral sides which are offset from the plane containing the central portion 82 to thereby create channel sections 84*a*, 84*b*. When the support plate 80 is secured to the step housing 50, the channel sections define channels through the step housing interior 51 and communicate with apertures 70. The rails 30*b* of the slide members 30 are attached to the lateral sides of the support plate 80, at the channels sections 84*a*, 84*b*. The rails 30*a* are secured to the side walls 76 of the connecting members 72. The support plate 80 further includes a pair of laterally outwardly extending flanges 86*a*, 86*b* provided along the sides thereof. Slots 88 in the flanges 86*a*, 86*b* are spaced and arranged to engage the intermediate walls 54 and/or ribs 56 formed within the step housing 50 to thereby facilitate alignment of the support plate 80 within the step housing 50. The cover 52 is secured to the support plate 80 by threaded fasteners 90 installed into a lower side of the cover 52, and the support plate 80 is in turn secured to the step housing 50 by threaded fasteners (not shown) installed from the bottom side 36 of the step housing 50, so that the fasteners are hidden from view and the step 12 has a clean appearance. In the embodiment shown, bosses 92 are formed integrally integrally with the step housing 50, at the rear side 44, for engaging the support plate 80 and installing fasteners therethrough.

The step 12 further includes first and second lower support members 100 coupled to the bottom side 36 of the step 12, near the front end 42. The lower support members 100 are biased toward first positions, outwardly from the bottom side 36, to suspend the step housing 50 a distance D above the floor surface 32 (FIG. 3A) so that the step 12 may be more easily moved between the stowed and extended positions. When a load is applied top the step 12, such as when a person stands on the step 12 to mount or dismount the table 10, the lower support members 100 are displaced away from the first positions, inwardly toward second positions so that the bottom side 36 of the step housing 50 at least partially engages the floor surface 32 (FIG. 3B). In the embodiment shown, the lower support members 100 include rollers or wheels 102 to reduce sliding friction between the step housing 50 and the floor surface 32 when the step 12 is moved between the stowed and extended positions. The rollers are provided on trailing arms 106 that are pivotally coupled to the step housing 50 by clevis brackets 108 and pins 110 associated therewith. The pivotal attachment between the trailing arms 106 and the housing 50 prevents binding of the lower support members 100 when they are displaced toward the second position under load. The wheels 102 and trailing arms 106 may be formed from ABS or other polymeric materials, or they may be formed from various other materials suitable for supporting a step 12 on the floor surface 32 and coupling the wheel 102 to the step housing 50. While the embodiments shown and described herein depict lower support members 100 having rollers or wheels 102, it will be recognized that the lower support members 100 may alternatively comprise glide elements that permit the step 12 to be slid across the floor surface 32 without rolling.

In the embodiment shown, the lower support members 100 are biased outwardly from the bottom side 36 of the step 12 by springs 120 disposed between the trailing arms 106 and bosses 122 provided on the step housing 50. It will be recognized, however, that the lower support members 100 may be biased outwardly from the step housing 50 using various other biasing members, such as pneumatic or elastomeric members, or other methods suitable for resiliently suspending the step 12 above the floor surface 32. Preferably, the biasing springs 120 have a very low spring rate to minimize the perception of movement by persons traversing the step 12. In one embodiment, each spring 120 has a spring rate of approximately 22 pounds per inch. To further minimize the perception of deflection while the step 12 is being loaded, the lower support members 100 and biasing springs 120 should be configured to provide no more than about ¼ inch deflection of the step 12 under load.

The step 12 further includes one or more gripping elements 130 provided on the bottom side 36 of the step 50 and configured to engage the floor surface 36 when the lower support members 100 deflect under load. The gripping elements 130 may be formed from relatively soft durometer polymeric materials, and may include serrations 132 or other tread patterns formed in the floor engaging side to provide increased grip between the gripping element 130 and the floor surface 36. In the embodiment shown, the gripping elements 130 have a generally elongate shapes to provide improved gripping in directions lateral to the step. Holes or apertures 134 are formed laterally through the gripping element 130 to allow the gripping element 130 to more easily deflect under load.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A medical examination table, comprising:

table structure including a patient support surface adapted to support a patient thereon;

a bay defined in said table structure for receiving a stowable step therein;

a step operatively coupled to said table, proximate said bay, for movement between a first position wherein said step is received within said bay, and a second position wherein said step extends outwardly from said bay;

said step comprising:

a step housing including a top side, a bottom side opposite said top side, first and second oppositely disposed lateral sides extending between said top side and said bottom side, and oppositely disposed front and rear sides extending between said top side, said bottom side and said first and second lateral sides, and at least one aperture formed into said step housing and providing access to an interior of said step housing; and at least one slide member operatively coupled between said step housing and said table structure;

at least a portion of said slide member slidably movable into and out of said step housing interior through said aperture to at least partially support said step in said first and second positions;

said aperture spaced inboard from said first and second lateral sides such that said slide member is enclosed within said step housing or said bay when said step is in said second position.

2. The medical examination table of claim 1, further comprising:

at least one lower support member disposed proximate said bottom side of said step housing;

said step housing at least partially supported on said lower support member.

3. The medical examination table of claim 2, wherein said lower support member is biased in a direction outwardly from said bottom side of said step housing to engage a floor surface;

said lower support member having a first position extending outwardly from said bottom side of said housing, when said step is unloaded, to support said bottom side above the floor surface, and a second position displaced from said first position to permit said bottom side to at least partially engage the floor surface when a load is applied to said step.

4. The medical examination table of claim 3, wherein said lower support member comprises a rolling element to reduce sliding friction between said step and the floor surface.

5. The medical examination table of claim 3, further comprising:

a gripping element disposed on said bottom surface of said step housing, said gripping element suspended above the floor surface when said lower support member is in said first position, and engaging the floor surface when said lower support member is in said second position.

6. The medical examination table of claim 1, wherein said step comprises:

first and second apertures formed into said step housing; and first and second slide members operatively coupled between said table structure and said housing;

each of said first and second slide members respectively associated with one of said first and second apertures;

at least a portion of each of said first and second slide members slidably movable into and out of said step housing interior, through said respective first and second apertures, to at least partially support said step in said first and second positions.

7. The medical examination table of claim 1, wherein said slide member is operatively coupled to said table structure for pivotal movement with respect thereto.

8. A medical examination table comprising:

table structure including a patient support surface adapted to support a patient thereon;

a bay defined in said table structure for receiving a stowable step therein;

a step operatively coupled to said table, proximate said bay, for movement between a first position wherein said step is received within said bay, and a second position wherein said step extends outwardly from said bay;

said step comprising:

a step housing including a top side, a bottom side opposite said top side, first and second oppositely disposed lateral sides extending between said top side and said bottom side, and oppositely disposed front and rear sides extending between said top side, said bottom side and said first and second lateral sides, and at least one aperture formed into said step housing and spaced inboard from said first and second lateral sides, said aperture providing access to an interior of said step housing;

at least one slide member operatively coupled between said step housing and said table structure;

at least a portion of said slide member slidably movable into and out of said step housing interior through said aperture to at least partially support said step in said first and second positions; and a connecting member having a first end pivotally coupled to said table, and a second end operatively coupled to said slide to facilitate pivotal movement between said slide and said table.

9. The medical examination table of claim 1, further comprising:

at least one channel defined in said step housing interior and receiving said slide member therein;

a cover received on said top side of said step housing and extending over said channel.

10. A medical examination table comprising:

table structure including a patient support surface adapted to support a patient thereon;

a bay defined in said table structure for receiving a stowable step therein;

a step operatively coupled to said table, proximate said bay, for movement between a first position wherein said step is received within said bay, and a second position wherein said step extends outwardly from said bay;

said step comprising:

a step housing including a top side, a bottom side opposite said top side, first and second oppositely disposed lateral sides extending between said top side and said bottom side, and oppositely disposed front and rear sides extending between said top side, said bottom side and said first and second lateral sides, and at least one aperture formed into said step housing and spaced inboard from said first and second lateral sides, said aperture providing access to an interior of said step housing;

at least one slide member operatively coupled between said step housing and said table structure, at least a portion of said slide member slidably movable into and out of said step housing interior through said aperture to at least partially support said step in said first and second positions;

at least one channel defined in said step housing interior and receiving said slide member therein;

a support plate received on said top side of said step housing;

said support plate defining at least a portion of said channel;

said slide member coupled to said support plate; and a cover received on said top side of said step housing and extending over said channel.

11. A medical examination table, comprising:

table structure including a patient support surface adapted to support a patient thereon;

a bay defined in said table structure for receiving a stowable step therein;

a step operatively coupled to said table, proximate said bay, for movement between a first position wherein said step is received within said bay, and a second position wherein said step extends outwardly from said bay, said step having oppositely disposed lateral sides;

at least one slide member coupled between said table structure and said step to at least partially support said step in said first and second positions;

said slide member including a first rail pivotally coupled to said table structure, and a second rail coupled to said step at a location inboard from said lateral sides, whereby said slide member is hidden from view when said step is in said second position, said first rail telescopingly coupled to said second rail.

* * * * *